US008142333B2

(12) United States Patent
LaTour

(10) Patent No.: US 8,142,333 B2
(45) Date of Patent: Mar. 27, 2012

(54) ROPELESS JUMP ROPE HAVING REPLACEABLE TIP

(76) Inventor: Brad LaTour, Annapolis, MD (US)

( * ) Notice: Subject to any disclaimer, the term of this patent is extended or adjusted under 35 U.S.C. 154(b) by 231 days.

(21) Appl. No.: 12/576,545

(22) Filed: Oct. 9, 2009

(65) Prior Publication Data

US 2010/0160116 A1 Jun. 24, 2010

Related U.S. Application Data

(60) Provisional application No. 61/140,656, filed on Dec. 24, 2008.

(51) Int. Cl.
*A63B 5/20* (2006.01)

(52) U.S. Cl. ..... 482/8; 482/81; 482/82

(58) Field of Classification Search ..... 482/1–9, 482/81, 900–902, 82, 83; 434/247
See application file for complete search history.

(56) References Cited

U.S. PATENT DOCUMENTS

| | | | | |
|---|---|---|---|---|
| 3,672,093 | A | 6/1972 | Meeks, Sr. | |
| 4,593,899 | A | 6/1986 | Miller | |
| 4,801,137 | A | 1/1989 | Douglass | |
| 5,058,883 | A | 10/1991 | Dybvik | |
| 5,314,393 | A | 5/1994 | Rubin et al. | |
| 5,478,297 | A | 12/1995 | Dennis, Jr. | |
| 5,662,561 | A | 9/1997 | McNamara | |
| 5,697,871 | A | 12/1997 | Landfair | |
| 5,749,812 | A | 5/1998 | Feciura et al. | |
| 5,842,956 | A | 12/1998 | Strachan | |
| 5,895,341 | A | 4/1999 | Jones | |
| 6,113,520 | A | 9/2000 | Greiner | |
| 6,404,409 | B1 * | 6/2002 | Solomon | 345/31 |
| 6,409,636 | B1 | 6/2002 | Risso et al. | |
| D470,902 | S | 2/2003 | Davies | |
| 6,530,866 | B2 | 3/2003 | Lo et al. | |
| 6,544,148 | B1 | 4/2003 | Loew | |
| 6,551,222 | B1 | 4/2003 | Beaver | |
| D477,853 | S | 7/2003 | Davies | |
| 6,752,746 | B1 | 6/2004 | Winkler et al. | |
| 7,037,243 | B1 | 5/2006 | Clancy | |
| 7,354,383 | B2 | 4/2008 | Bardha | |
| 2004/0002408 | A1 | 1/2004 | Rigas | |
| 2005/0026749 | A1 | 2/2005 | Pak | |
| 2005/0288158 | A1 | 12/2005 | LaTour | |
| 2009/0221401 | A1 * | 9/2009 | Lovett et al. | 482/82 |
| 2011/0130247 | A1 * | 6/2011 | Lovett et al. | 482/3 |

FOREIGN PATENT DOCUMENTS

| | | | |
|---|---|---|---|
| CN | 2356706 | Y | 1/2000 |
| CN | 2467122 | Y | 12/2001 |

* cited by examiner

*Primary Examiner* — Glenn Richman
(74) *Attorney, Agent, or Firm* — 24IP Law Group; Timothy R. DeWitt

(57) ABSTRACT

In a preferred embodiment, the present invention is a ropeless jump rope having a pair of handles wherein each handle comprises a housing having a removable rotatable tip at one end to which a flexible elongated member such as a rope, or string is secure to the tip such that an end portion of the flexible elongated member is attached to the tip in a manner substantially perpendicular to the axis of rotation of the tip. Each handle further comprises a flexible support member positioned on the tip and the end portion of the flexible elongated member thereby preventing damage to the flexible elongated member during use of the invention.

14 Claims, 8 Drawing Sheets

ROPELESS JUMP ROPE HAVING REPLACEABLE TIP

CROSS-REFERENCE TO RELATED APPLICATIONS

This application claims the benefit of the filing date of U.S. Provisional Application Ser. No. 61/140,656 entitled "Replaceable Tip for Ropeless Jumprope" filed by inventor Brad LaTour on Dec. 24, 2008, which is hereby incorporated by reference herein in its entirety.

Applicant also is the named inventor on U.S. Patent Application Publication No. 2005/0288158 published on Dec. 29, 2005, and U.S. Provisional Patent Application Ser. No. 60/582,173 entitled "Jump snap—ropeless jump rope," and filed on Jun. 24, 2004, both of which likewise are hereby incorporated by reference in their entirety.

STATEMENT REGARDING FEDERALLY SPONSORED RESEARCH OR DEVELOPMENT

None.

BACKGROUND OF THE INVENTION

1. Field of the Invention

The present invention relates to jump rope simulators and, more particularly, to a jump rope simulator for providing a physical workout by simulating the jumping of rope while monitoring and displaying workout data.

2. Brief Description of the Related Art

A variety of conventional jump rope simulators are known. One example of such a prior art jump rope is disclosed in U.S. Pat. No. 5,895,341, which discloses a pair of hand-held units, each unit having a handle with an elongate flexible cord attached thereto. The flexible cord has a distribution of weight biased away from the handle to facilitate a twirling motion. The flexible cord on each handle may be twirled about an axis extending form the handle.

SUMMARY OF THE INVENTION

In a preferred embodiment, the present invention is a ropeless jump rope handle. The handle is comprised of a handle housing having first and second ends, a rope simulating element having first and second ends, and a head assembly connected at one end of the handle housing. The head assembly comprises a support element fixed to the handle housing, a rotating element rotatably connected to the support element, the rotating element having means therein for connecting the first end of the rope simulating element thereto, and a flexible element covering a portion of the rotating element and the end portion of the rope simulating element. The rotating element may comprise a stem rotatably connected to the support element and a tip removably connected to the stem wherein the tip comprises means for connecting the first end of the rope simulating element thereto. The handle may further comprise a counting mechanism or counter for counting rotations of the rotating element. An electronic counter is preferable. The means therein for connecting the first end of the rope simulating element thereto may comprise a opening substantially perpendicular to an axis of the rotating element. The head assembly may further comprise means for connecting the head assembly to the handle housing.

In another preferred embodiment, the present invention is a ropeless jump rope handle comprised of a handle housing having first and second ends, a rope simulating element having first and second ends, and a head assembly connected at one end of the handle housing. The head assembly comprises a support element fixed to the handle housing, a rotating element rotatably connected to the support element. The rotating element comprises a rod having first and second ends opposite one another, an outwardly extending flange near the first end of the rod for engaging with the support element, and a hole near the second end of the rod for receiving a first end of the rope simulating element. A flexible element or sleeve covers a portion of the rotating element and a portion of the rope simulating element near the first end of the rope simulating element and a weight is connected to the second end of the rope simulating element. The rod may comprise a stem rotatably connected to the support element and a tip removably connected to the stem, such as with a screw.

In still another embodiment, the present invention comprises a ropeless jump rope handle having a handle housing with first and second ends, a rope simulating element having first and second ends, and a head assembly connected at one end of the handle housing. The head assembly comprises a head housing, a stem rotatably mounted to the head housing wherein a portion of the stem extends out of the head housing and a tip removably mounted to the portion of the stem extending out of the head housing and the rope simulating element is connected to the stem. A flexible element may cover a portion of or all of the tip and a portion of the rope simulating element near the stem. A weight is connected to the second end of the rope simulating element. The handle housing may comprises a flange adjacent the end of the handle housing to which the head assembly is connected and the head housing comprises means for engaging with the flange to fix the head housing to the handle housing. The handle housing further comprises a compartment or compartments therein for receiving a weight or a plurality of weights. A ropeless jump rope handle may further comprise an end cap removably connected to the second end of the handle. Still further, the handle may further comprise a microprocessor within the handle housing, a display mounted to the handle housing and connected to the microprocessor, a control mounted to the handle housing and connected to the microprocessor, a heart rate monitor and a counting mechanism for counting rotations of the stem. The stem may compriss a keyed opening at one end for receiving an end of the tip and the tip may comprise a keyed portion for engaging with the keyed opening in the stem.

Still other aspects, features, and advantages of the present invention are readily apparent from the following detailed description, simply by illustrating preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

The present invention presents a novel combination of elements that collectively produce a jump rope simulator having multiple functions and adjustments that facilitate exercise. A preferred embodiment of the invention has two handles, one referred to as a "primary" or "smart" handle and the other referred to as a "secondary" or "dumb" handle.

Figure 1:
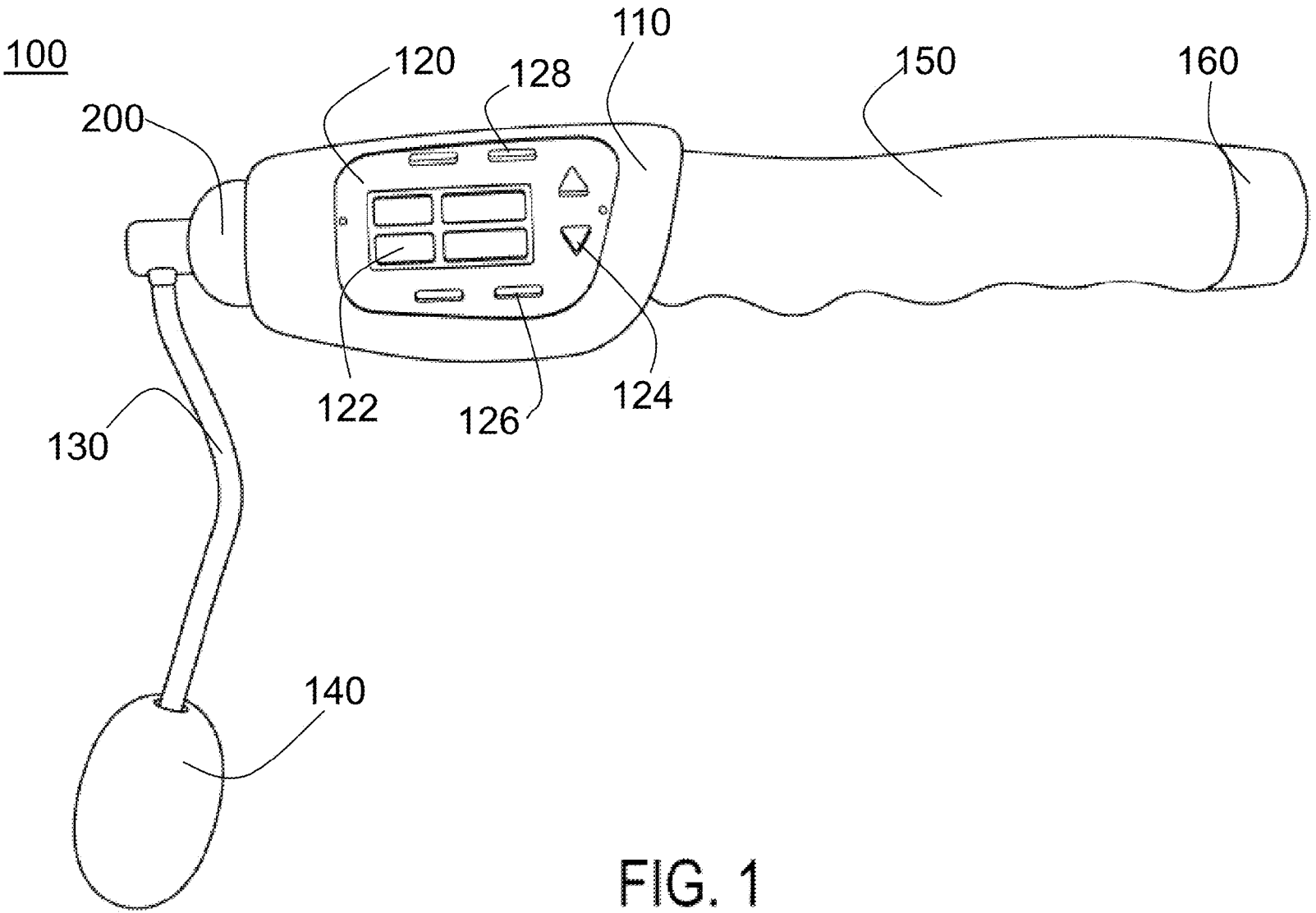
FIG. 1 is a side view of a preferred embodiment of the present invention.
Figure 2:
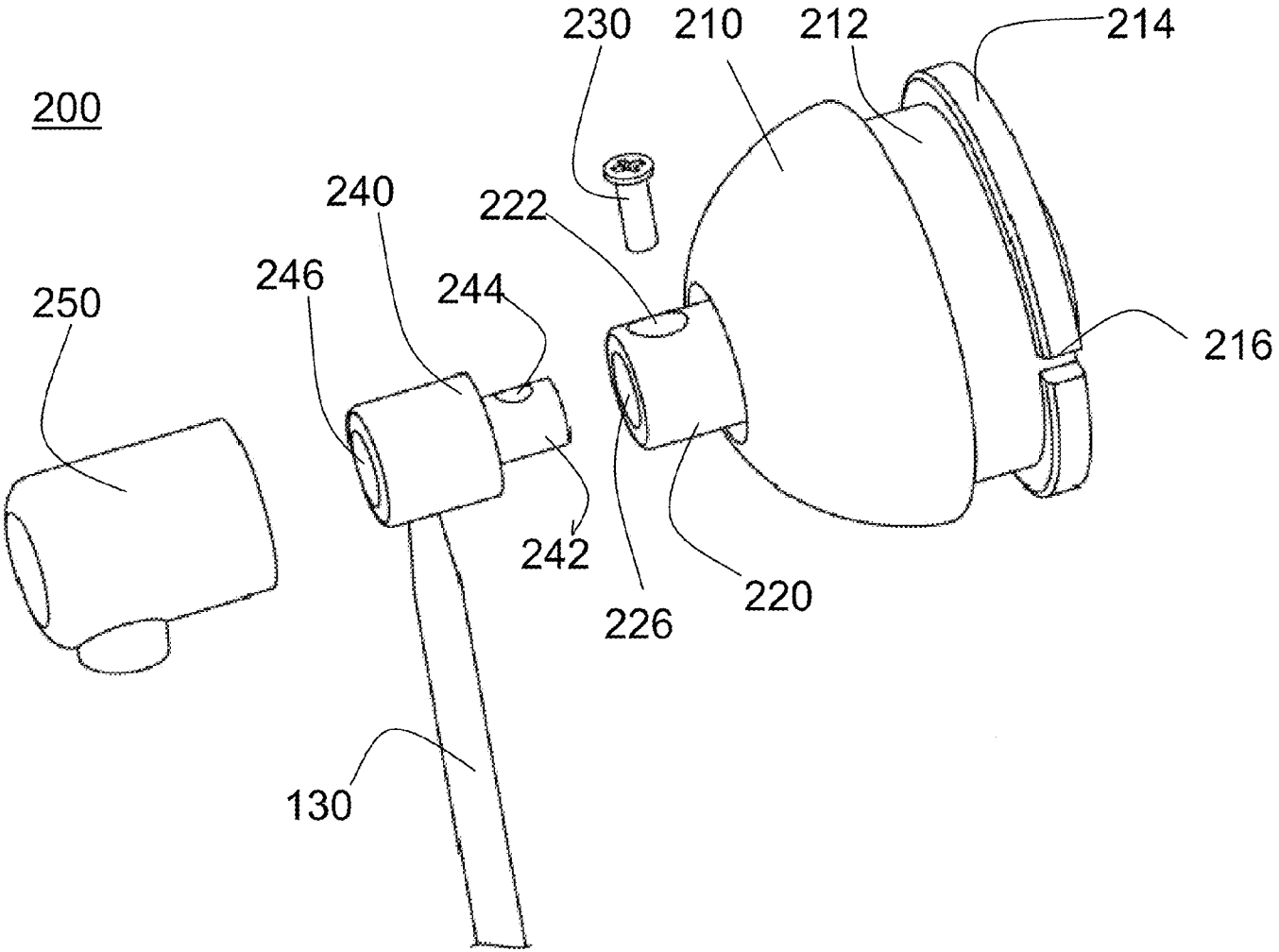
FIG. 2 is an assembly view of a head or tip assembly of a preferred embodiment of the present invention.

A preferred embodiment of a smart handle of the present invention is described with reference to the Figures. As shown in FIG. 1, a ropeless jump rope handle 100 in accordance with a preferred embodiment of the present invention has a housing 110 that preferably is elongate, hollow and generally cylindrical in shape. The housing 110 may be formed in other shapes provided that the housing may be gripped by a hand. Further, at one end, the housing has an opening for receiving a weight or weights (not shown). The inner surface of housing 110 adjacent the opening is threaded with threads 112 for mating with a threaded portion 162 of an end cap or plug 160. The end cap 160 may be formed of any suitable material such as metal, plastic or rubber. The housing may be formed of any suitable material, such as metal, plastic or wood, but preferably is a rigid material. The housing preferably is approximately eight inches in length and has a diameter in a range suitable to be gripped by any of a variety of sizes of hands after a foam or rubber grip 150 is placed on the handle. In an alternative embodiment, the handle grip may be integral with the housing such as with the housing and grip both being formed from molded plastic.

Figure 3:
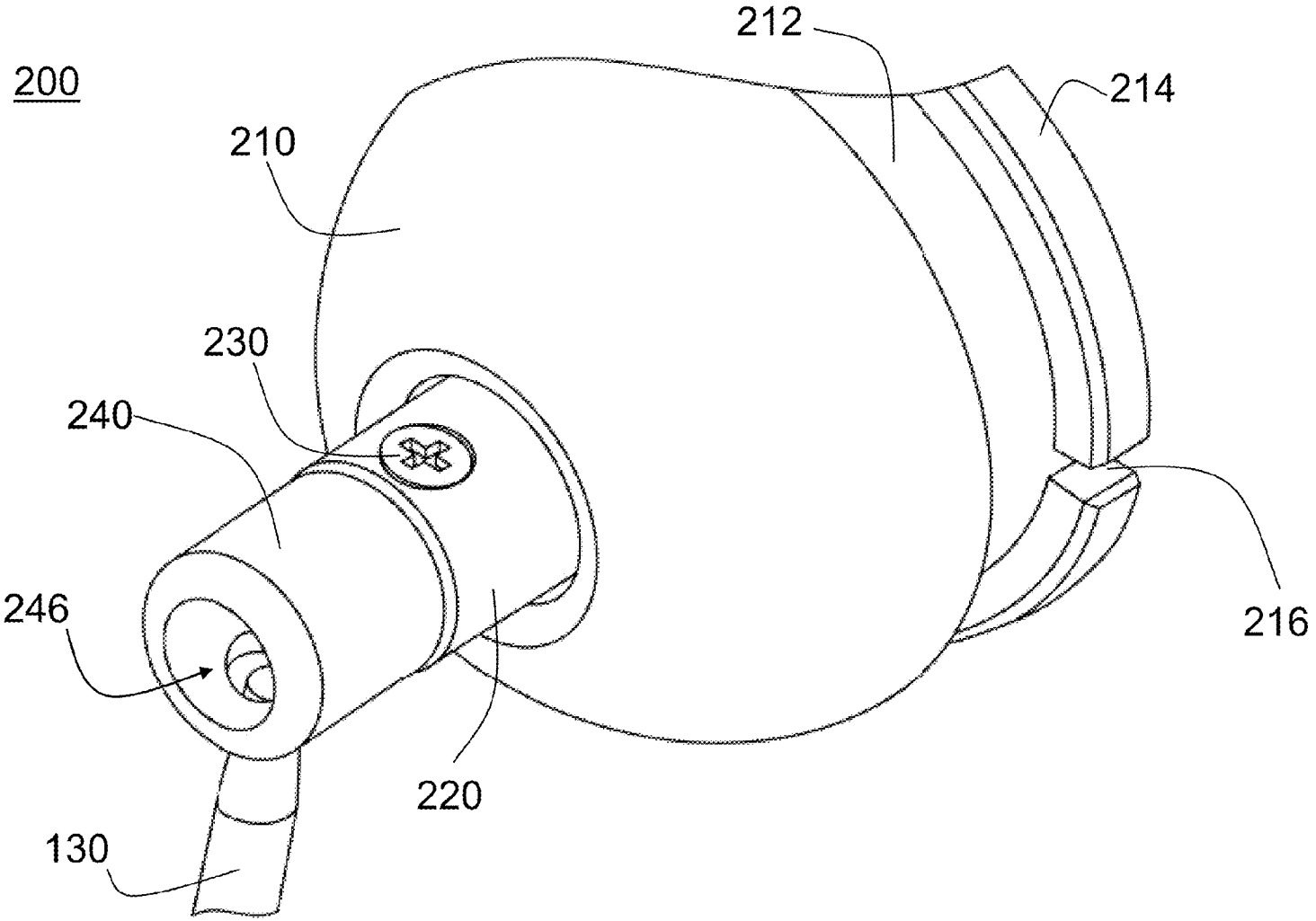
FIG. 3 is a first intermediate perspective view of a tip assembly of a preferred embodiment of the present invention.
Figure 4:
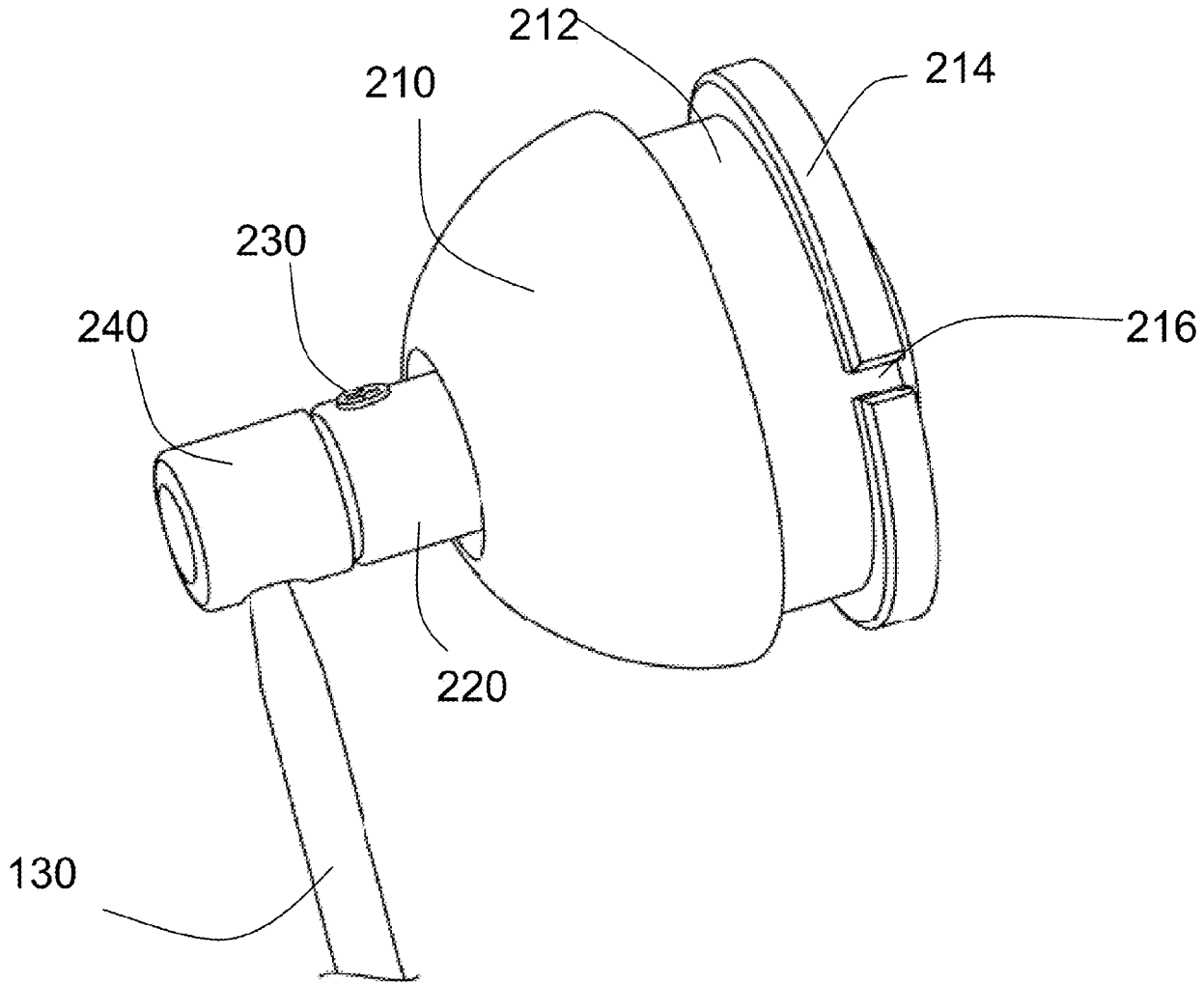
FIG. 4 is a second intermediate perspective view of a tip assembly of a preferred embodiment of the present invention.
Figure 5:
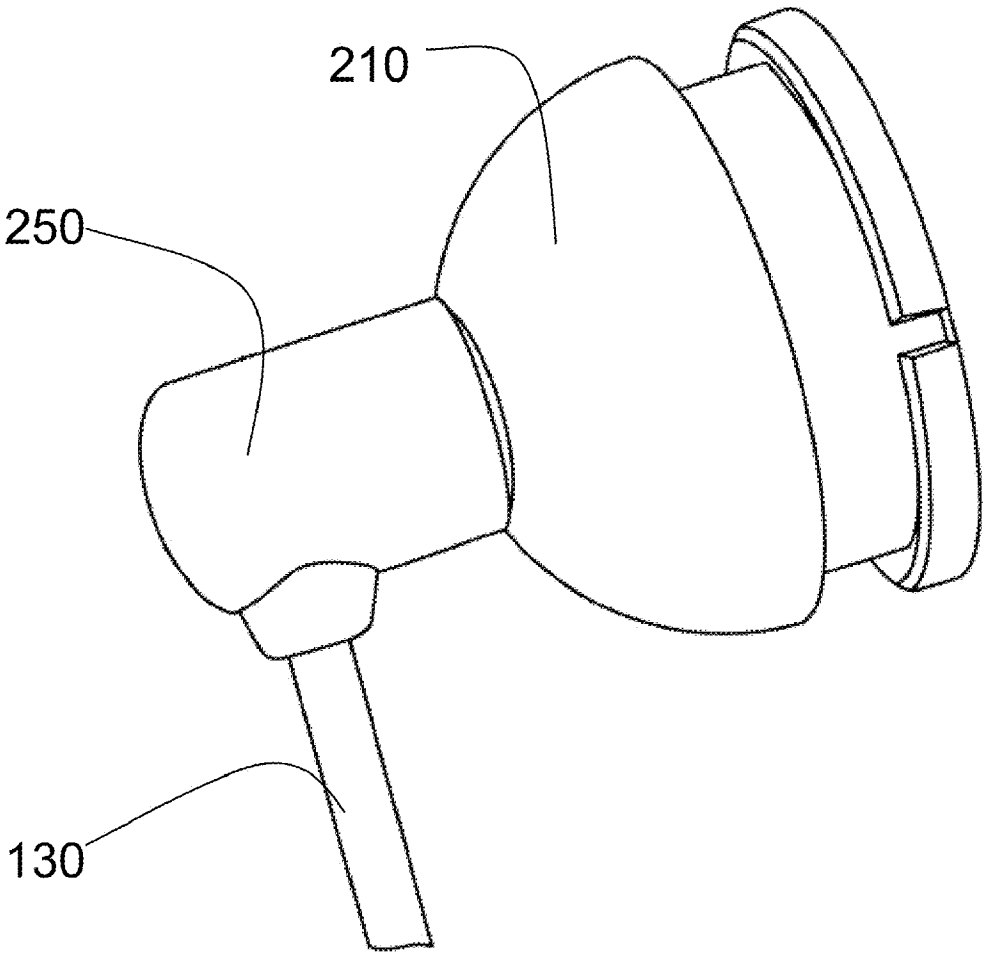
FIG. 5 is a perspective view of a tip assembly of a preferred embodiment of the present invention.
Figure 7:
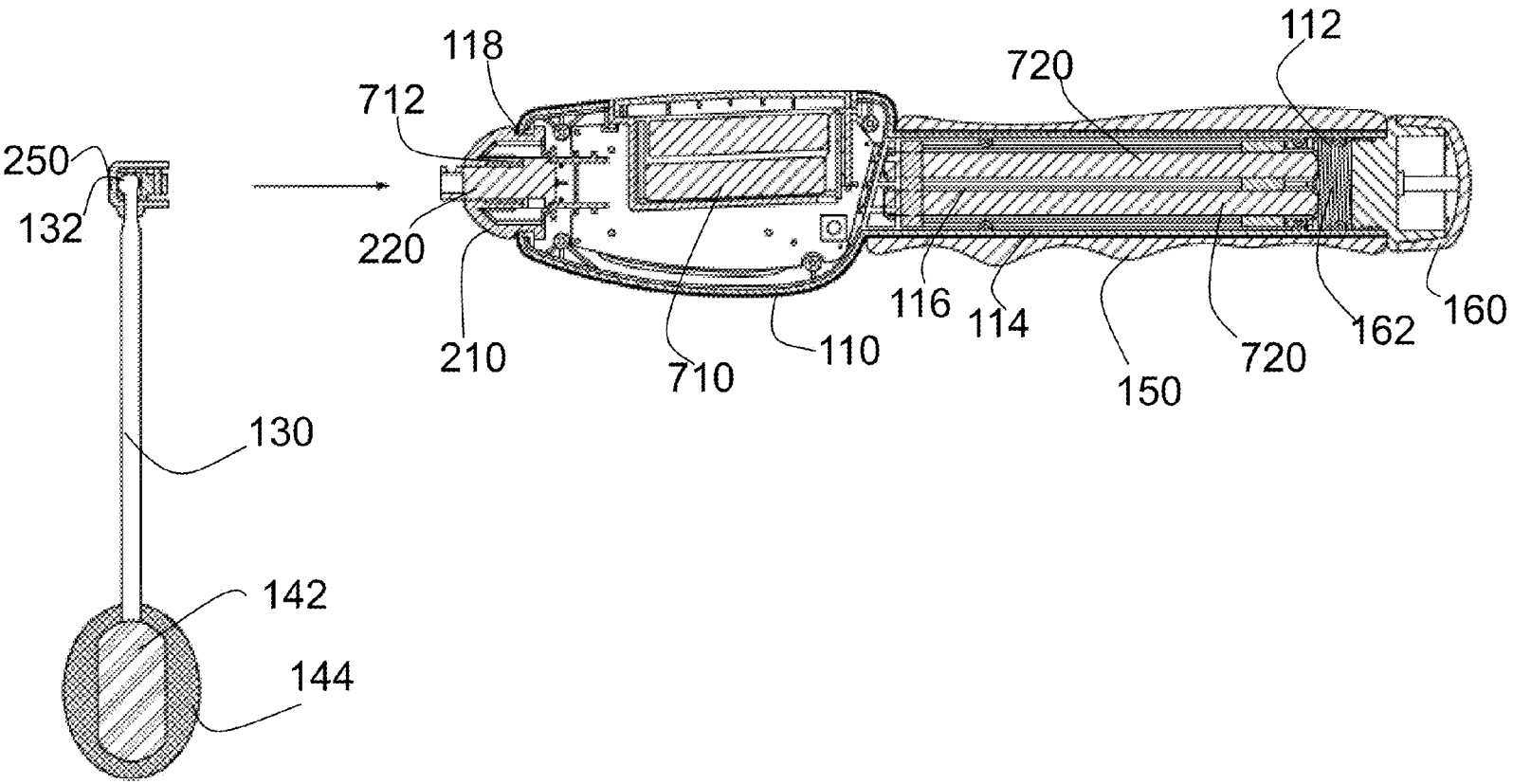
FIG. 7 is a cross-section of a preferred embodiment of the present invention.

In a preferred embodiment, the grip 150 is placed over a portion of the housing 110 adjacent the end of the housing 110 that will receive the end cap 160. In a preferred embodiment, the grip 150 is approximately six inches in length, but other lengths of grips may be used with the invention. The grip 150 may take on any of a variety of shapes, but in a preferred embodiment, the grip is formed with a plurality of finger grip sections such as is shown in FIGS. 1 and 7. It will be understood by those of ordinary skill in the art, that this is only one embodiment, and that in other embodiments, such as is shown in FIGS. 1 and 3, the grip is open on both ends and an end cap 132 is used to cover the end of the housing.

The housing 110 may include a variety of openings or holes in its sidewalls to accommodate various components of the system. One such opening may be for receiving one or more sensors for a pulse monitor. The pulse monitor is placed in the grip portion of the housing in this particular embodiment. Thus, the grip 150 also would have an opening or openings for the sensor(s). Pulse monitors are generally known in the fitness field, and any suitable pulse monitor and sensor arrangement may be used with the invention. Alternatively, the primary handle may incorporate a receiver (not shown) for receiving data from a conventional pulse rate monitor such as one having sensors in a chest strap.

When the grip 150 is in place, a portion of the housing 110 extends out of the grip 150. That portion of the housing 150 extending beyond the grip shall be referred to for reference purposes as the display/control portion of the housing. While it is described here as a portion of the housing distinct from the grip portion, it will be under stood that the invention may be incorporated with a unitary structure, for example, such that the entire length of the housing is covered by the grip 150, but the grip 150 has one or more openings for receiving one or more displays and controls.

In a preferred embodiment shown in FIG. 1, the display/control portion of the housing houses a battery compartment 710 for supplying power to the electronics in the primary handle. The electronics in the embodiment shown in FIG. 1 include a plurality of displays 122 for displaying information, such as estimated calories burned, exercise time, turn count, and heart rate. Other information such as time of day, average pulse, average turns per minute, or the like may be displayed in addition to or instead of this information. The displays may be arranged in any manner, but are shown in FIG. 1 as being part of a display/control panel 120.

On the housing 110 is mounted a display/control panel 120 having a plurality of displays 122 and a plurality of controls 124, 126, 128 for controlling various functions of the electronics, such as power on/off, reset, and the like. Many different types of controls may be used with the invention. In an alternative embodiment, a single display 122 may be used for displaying all system information. With such a single display, various types of information may be cycled across the screen at preset or selected intervals or a display control 128 may be provided for permitting a user to select which information they would like to display.

An end cap 160 having a threaded portion 162 is removably secured to the housing 110 by engaging the threads 162 with corresponding threads 112 on the interior of the housing 110. The interior of the portion of the housing 110 covered by grip 150 has structural elements 114, 116 defining channels 720 into which weights may be inserted. In a preferred embodiment, three identically sized weights can be inserted into the housing, but other variations such as a single weight or differing weights can be used with the invention. The housing 110 further has within it a battery compartment 710 for receiving batteries to power the electronics.

At an end of the housing 110 opposite the end cap 160, a head assembly 200, including a counting mechanism or means, is mounted to the housing 110. A first end of a rope simulating element formed for example of a flexible member 130 such as a rope, string or wire extends from the head assembly 200 and has a weight 140 secured to it at an opposite end. The weight 140 may be formed in any of a variety of ways such as by having a central weight portion 142 surrounded by padding 144. The weight may be formed of a variety of materials, such as steel, rubber or plastic.

As shown in FIGS. 2-5, the head assembly 200 has a head housing 210 having ridges, flanges, tongue and groove structures or other means 212, 214, 216 for attaching the head housing 210 (and hence the head assembly 200) to the housing 110 by engaging with similar a corresponding structure 118 on the housing 110. The head assembly 200 further has rotating element, for example, a hollow cylindrical stem 220 rotatably mounted in or to the head housing 210 via a support element 712, such that a portion of the rotating element or stem 220 extends out of the head housing 210. Support element 712 may be fixed to the housing 110, may be formed integral with the housing 110, or may be formed of several elements working in combination to support the stem 220. The stem 220 has a central channel 226 through its center and an opening or mounting hole 222 for receiving a screw 230 to mount a tip 246. In this manner the tip is removable or replaceable. Other known means for removably securing the tip to the stem of course may be used with the present invention. The tip 246 is cylindrical and hollow and has a narrow portion 242 for insertion into the opening 226 in stem 220. The narrow portion 242 has a threaded hole 244 for receiving threads on mounting screw 230 when the head assembly is assembled. The tip 240 further has a first opening 246 at one end and a second opening 248 in its sidewall. The opening 248 receives rope 130 when the product is assembled. The rope 130 may be mounted to the head assembly 200 in any of a variety of ways, such as by having an enlarged element 132 as shown in FIG. 7 or by being threaded through the channel 226 in stem 220 and then being secured in the interior of the head housing 210. The head assembly 200 further has a flexible sheath or element 250, such as rubber, polyethylene or other suitable material, placed over the tip 240, the portion of the stem 220 extending from the head housing 210, and a portion of the roe 130 extending out of the hole 248 in the tip 240.

Figure 6:
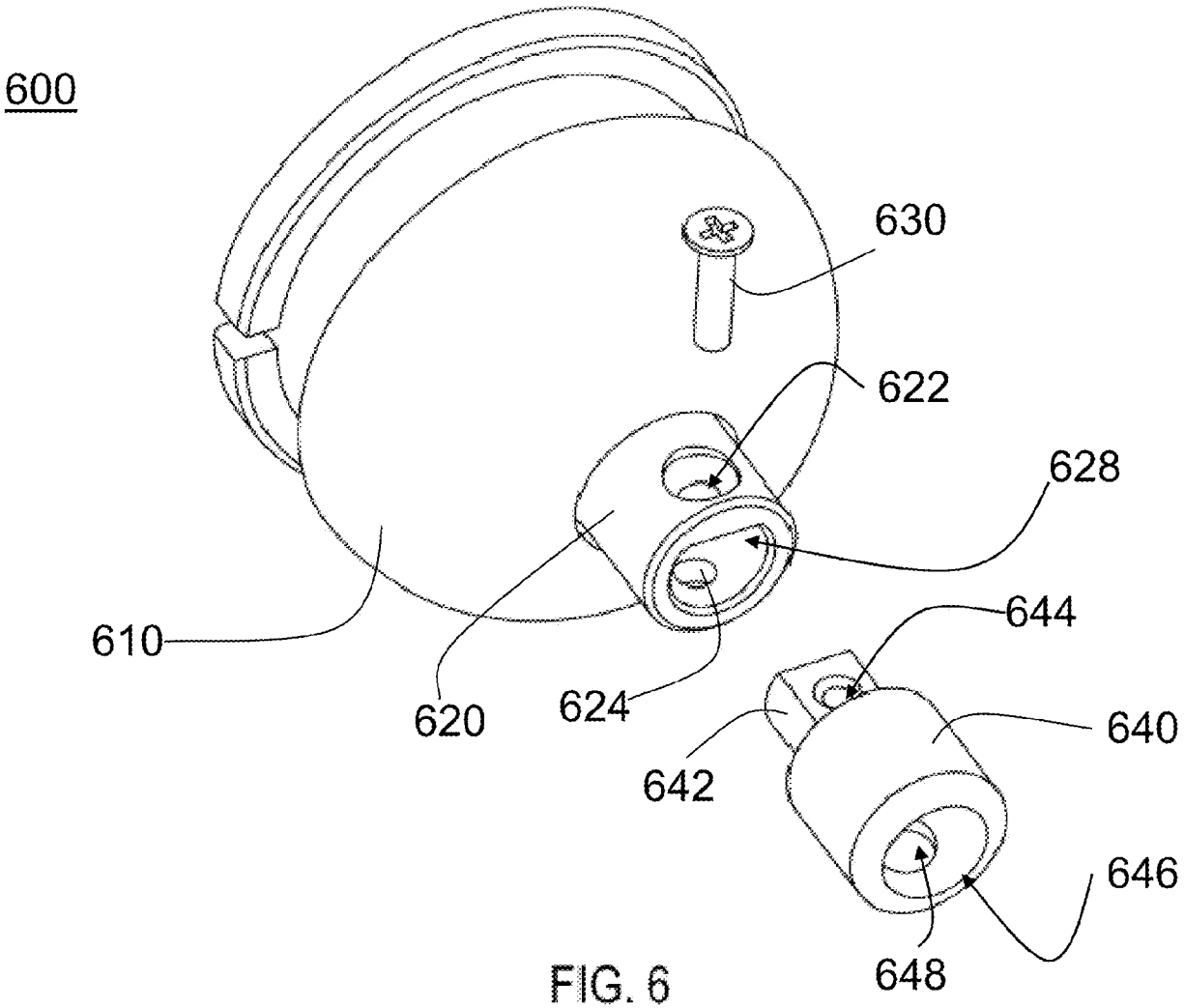
FIG. 6 is a partial assembly view of a tip assembly in accordance with another preferred embodiment of the present invention.

FIG. 6 illustrates an alternate embodiment for a head assembly 600 in which the narrow portion 642 of tip 640 is keyed (with a flat portion), as is the channel 628 in stem 620. A hole 644 is formed in the flat or keyed portion of the narrow portion 642 of the tip 640 and when assembled, aligns with hole 622 in stem 620 such that threaded screw 630 extends through both hole 622 and hole 644 and is threaded into hole 624 in the stem 620. Again, this structure facilitates easy removal or replacement of the tip in the event the tip or the roe simulating element are damages in any way.

When the handles are used, they are moved by the user to cause the weights at the end of the rope simulating element to swing and thereby rotate the stem. In the process, the flexible portion of the rope simulating element can rub against the stem and fray or otherwise become damaged. The flexible element placed over the stem and an end portion of the rope simulating element supports and protects the rope simulating element thereby reducing or preventing fraying or other damage to the rope simulating element.

Since ropeless jump rope handles typically are sold in pairs, a second ropeless jump rope handle having or not having display/control 120 or any electronics therein may be paired with the handle shown in FIG. 1. An embodiment of a secondary or dumb handle, for example, may have a housing having a grip portion covered by a grip and a "dummy" portion. The end of the grip portion of the housing has an opening for receiving a weight and an end cap for retaining the weight within the housing. As with the primary handle, the inner side of the housing adjacent the opening may be threaded for mating with a threaded portion of the end cap. The end caps for the primary and secondary handles preferably are identical in size and structure and are interchangeable. Likewise, the primary and secondary housings preferably each have a chamber 720 within their hollow interiors for receiving a weight or weights. A variety of weights having different weights, such as ½, 1, and 1½ pounds, may be used, but preferably should be of similar size.

Figure 8:
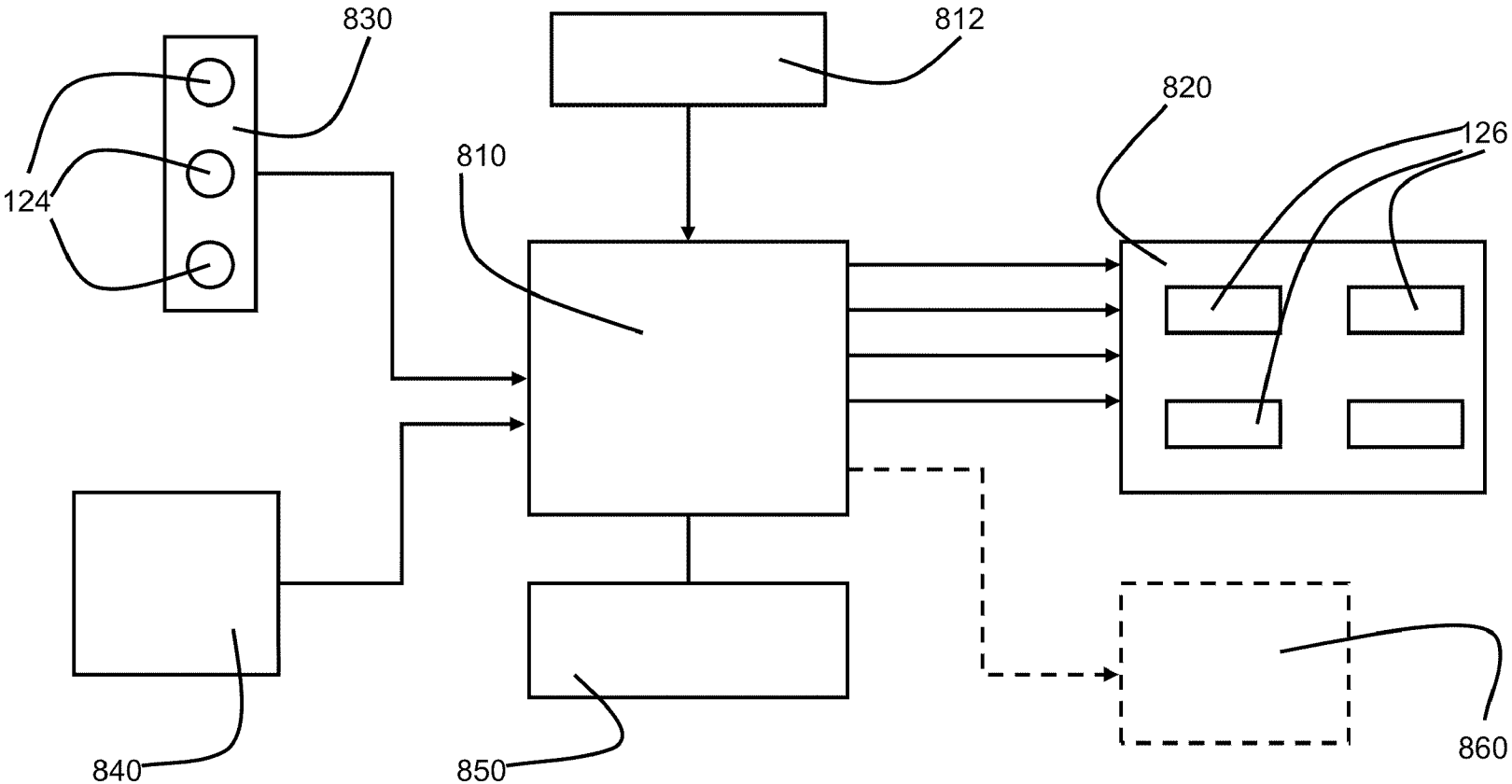
FIG. 8 illustrates the architecture of the electronics in a preferred embodiment of the invention.

A preferred embodiment of a system architecture for the electronics in the primary handle is shown in FIG. 8. A microprocessor 810 stores various data and processes within its internal memory (not shown) and is power by battery 850. The stored data may of any of a variety of types, may be simple or complex, and may be generic or specific to a user. For example, the data may be limited to the current workout or may include date and time information from a variety of past workouts or even a variety of users to provide users with records of their workouts or long periods of time. An alternative embodiment could include means, such as a USB, infrared or Ethernet port, for downloading or exporting information to a separate device such as a PC or a PDA. Such a means for exporting data further could be a port for receiving a memory device such as a flash memory, a memory stick, or the like. Such means also could be used for importing or uploading data, music, software or workout programs.

The microprocessor receives inputs from controls 830, counting mechanism 840 and heart monitor 812. The controls may be simple or complex depending on the particular embodiment. The controls may permit customization of a variety of factors, such as by permitting a user to enter identifying information and setting workout preferences such as desired heart rate ranges, workout time limits or intervals. The controls 830 may provide for a variety of inputs, such as on/off, reset, pulse range, turn pace and the like may be provided. Likewise, the controls may be used to set desired heart rate ranges, workout times, or workout intervals. The controls may come in any of a variety of forms from simple on/off and reset button controls to arrow keys, enter buttons and display menus.

Microprocessor 810 processes the various data received and outputs display data to display panel 820, which has one or more displays 122. The microprocessor may calculate and/or cause the display 820 to display a variety of information relating to the user including, but not limited to, turn count, turns per minute, average turns per minute, estimated total calories burned, estimate calories burned per time increment, time, running time, remaining workout time, heart rate, average heart rate, maximum heart rate, and minimum heart rate.

In an alternative embodiment, the system may have a speaker 860 or speakers for making various sounds such as a simulated click of a rope. As noted above, the primary handle has a counting mechanism or device within the handle that counts each rotation of the metal rod or stem on its axis in order to produce statistical analysis of the users exercise. The handle utilizes an internal computer device or processor to record the number of rotations, rate of rotation, calculate calories burned during use, and the time of use. The primary handle also generates a "snap" sound that simulates the sound made by a traditional jump rope hitting a solid surface such as cement upon completion of each rotation in either direction. Beeps or other sounds may be used to denote particular time intervals such as one, five, or ten minute increments. Sounds likewise may be used to indicate, for example, that a minimum heart rate has been reached or a maximum heart rate has been exceeded. Additional sounds, such as a pace indicator likewise may be used. Such sounds emitting from the speaker may be as simple as beeps or may be more complex sounds such a music or voice recordings. Alternatively, a headphone jack may be used in place of an internal speaker.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A ropeless jump rope handle comprising:

a handle housing having first and second ends;

a rope simulating element having first and second ends;

a head assembly connected at one end of said handle housing, said head assembly comprising:

a support element fixed to said handle housing;

a rotating element rotatably connected to said support element, said rotating element having means therein for connecting said first end of said rope simulating element thereto, wherein said rotating element comprises:

a stem rotatably connected to said support element; and a tip removably connected to said stem, said tip comprising means for connecting said first end of said rope simulating element thereto;

wherein said stem comprises a keyed opening at one end for receiving an end of said tip and said tip comprises a keyed portion for engaging with said keyed opening in said stem; and a flexible element covering a portion of said rotating element and said end portion of said rope simulating element.

2. A ropeless jump rope handle according to claim 1 further comprising a counting mechanism for counting rotations of said rotating element.

3. A ropeless jump rope handle according to claim 1 wherein said means therein for connecting said first end of said rope simulating element thereto comprising a opening substantially perpendicular to an axis of said rotating element.

4. A ropeless jump rope handle according to claim 1 wherein said head assembly further comprises means for connecting said head assembly to said handle housing.

5. A ropeless jump rope handle comprising:

a handle housing having first and second ends;

a rope simulating element having first and second ends;

a head assembly connected at one end of said handle housing, said head assembly comprising:

a support element fixed to said handle housing;

a rotating element rotatably connected to said support element, said rotating element comprising:

a rod having first and second ends opposite one another;

an outwardly extending flange near said first end of said rod for engaging with said support element; and a hole near said second end of said rod for receiving a first end of said rope simulating element;

a flexible element covering a portion of said rotating element and a portion of said rope simulating element near said first end of said rope simulating element; and a weight connected to said second end of said rope simulating element.

6. A ropeless jump rope handle according to claim 5 wherein said rod comprises:

a stem rotatably connected to said support element; and a tip connected to said stem.

7. A ropeless jump rope handle comprising:

a handle housing having first and second ends;

a rope simulating element having first and second ends;

a head assembly connected at one end of said handle housing, said head assembly comprising:

a head housing;

a stem rotatably mounted to said head housing, wherein a portion of said stem extends out of said head housing; and a tip removably mounted to said portion of said stem extending out of said head housing and said rope simulating element is connected to said portion of said stem extending out of said head housing; and a weight connected to said second end of said rope simulating element;

wherein said stem comprises a keyed opening at one end for receiving an end of said tip and said tip comprises a keyed portion for engaging with said keyed opening in said stem.

8. A ropeless jump rope handle according to claim 7 wherein said stem comprises:

a flexible element covering a portion of said tip and a portion of said rope simulating element near said stem.

9. A ropeless jump rope handle according to claim 7 wherein said handle housing comprises a flange adjacent said end of said handle housing to which said head assembly is connected and said head housing comprises means for engaging with said flange to fix said head housing to said handle housing.

10. A ropeless jump rope handle according to claim 7 wherein said handle housing further comprises a compartment therein for receiving a weight.

11. A ropeless jump rope handle according to claim 7 wherein said handle housing further comprises a plurality of compartments therein for receiving a plurality of weights.

12. A ropeless jump rope handle according to claim 7 further comprising an end cap removably connected to said second end of said handle.

13. A ropeless jump rope handle according to claim 7 further comprising:

a microprocessor within said handle housing;

a display mounted to said handle housing and connected to said microprocessor;

a control mounted to said handle housing and connected to said microprocessor; and a counting mechanism for counting rotations of said stem.

14. A ropeless jump rope handle according to claim 7 further comprising a heart rate monitor.

* * * * *